United States Patent [19]

Tokita

[11] Patent Number: 4,671,776

[45] Date of Patent: Jun. 9, 1987

[54] MANUFACTURING METHOD OF COLOR PICTURE TUBE

[75] Inventor: Kiyoshi Tokita, Fukaya, Japan

[73] Assignee: Kabushiki Kaisha Toshiba, Kawasaki, Japan

[21] Appl. No.: 648,143

[22] Filed: Sep. 7, 1984

[30] Foreign Application Priority Data

Sep. 13, 1983 [JP] Japan ..... 58-167449
Nov. 30, 1983 [JP] Japan ..... 58-224039

[51] Int. Cl.[4] ..... H01J 9/227

[52] U.S. Cl. ..... 445/51; 313/402; 430/23

[58] Field of Search ..... 313/402, 408; 445/47, 445/51; 430/5, 23

[56] References Cited

U.S. PATENT DOCUMENTS 3,668,002 6/1972 Okabe et al. ..... 313/402 X
3,703,374 11/1972 Okabe et al. ..... 445/52 X
3,822,454 7/1974 Speigel ..... 430/23 X
3,912,482 10/1975 La Grouw et al. ..... 445/45 X

FOREIGN PATENT DOCUMENTS 47-8261 3/1972 Japan .
2080612 2/1982 United Kingdom ..... 313/402

*Primary Examiner*—Kenneth J. Ramsey
*Attorney, Agent, or Firm*—Cushman, Darby & Cushman

[57] ABSTRACT

A manufacturing method of a color picture tube includes the steps of forming a shadow mask having a main surface portion in which a plurality of apertures are formed, coating at least one surface of the main surface portion of the shadow mask with ceramic material, heat-treating the shadow mask, thereby chemically bonding said ceramic material to said surface so as to remain the residual tensile stress in said shadow mask, and forming a phosphor screen, for emitting multi-color light by bombardment of the electron beams selectively transmitted through the apertures, on an inner surface of a panel using the shadow mask. The heat treatment of the shadow mask is performed before forming the phosphor screen to prevent improper change in the relationship between the positions of the apertures and phosphors due to residual tensile stress.

11 Claims, 5 Drawing Figures

MANUFACTURING METHOD OF COLOR PICTURE TUBE

BACKGROUND OF THE INVENTION

The present invention relates to a manufacturing method of a shadow mask type color picture tube and, more particularly, to a forming method of a shadow mask-screen system thereof.

In a shadow mask-type color picture tube shown in FIG. 1, an envelope formed of glass substantially consists of a rectangular panel 1, a funnel 2 and a neck 3. On an inner surface of the panel 1, for example, a stripe phosphor screen 4 which emits red, green and blue light is provided. On the other hand, in-line electron guns 6, which are linearly arranged along a horizontal axis of the panel 1 and emit three electron beams 10 corresponding to red, green and blue, are provided in the neck 3. A shadow mask 5 having a main surface portion in which a plurality of apertures are formed is disposed adjacent and opposed to the screen 4. A peripheral portion of the shadow mask 5 has a skirt portion 8 which is bent in correspondence with an outer shape of the panel 1. The skirt portion 8 is supported and fixed by a mask frame 7 consisting of a frame having an L-shaped cross-section. Furthermore, the mask frame 7 is engaged through a spring 9 with a pin (not shown) which is buried in an inner wall of the panel 1. In such a color picture tube, the three electron beams 10 emitted from the electron guns 6 are deflected by a deflection apparatus (not shown) provided near the funnel 2 of the outer portion of the envelope. The beams 10 are color-selected by the apertures of the shadow mask 5 while scanning a rectangular region substantially corresponding to the rectangular-shaped panel 1, and respectively and properly impinge on the corresponding color-emitting phosphor stripes, thereby forming a color image.

In this case, an effective amount of the electron beams 10 passing through the apertures of the shadow mask 5 is less than $\frac{1}{3}$ of the total electron beams emitted from the electron guns 6. The remaining electrons beams impinges on the shadow mask 5 and is converted into heat energy. For this reason, the shadow mask 5 can be heated to about 80° C. The shadow mask 5 comprises a thin plate having a thickness of 0.1 to 0.3 mm and is formed of cold-rolled steel mainly consisting of iron having a relatively large thermal expansion coefficient of $1.2\times10^{-5}$/°C. The mask frame 7 which supports the skirt portion 8 of the shadow mask 5 is formed of the same cold-rolled steel as that of the shadow mask 5 and having a thickness of about 1 mm and an L-shaped cross-section. A surface of the mask frame 7 is oxidized, thereby forming a black oxide layer thereon. Thermal expansion of the shadow mask 5 which is heated by bombardment of the electron beams 10 can easily occur. However, since the peripheral portion of the shadow mask 5 is in contact with the mask frame 7 which has been subjected to darkening and has a large thermal capacity, heat is transferred to the mask frame 7 from the peripheral portion of the shadow mask 5 by radiation and conduction. Therefore, the temperature of the peripheral portion of the shadow mask 5 becomes lower than that of the central portion thereof. For this reason, a so-called doming occurs in which the central portion of the shadow mask 5 is thermally expanded by a greater extent than the peripheral portion thereof. By this doming, the relationship between the position of the apertures of the shadow mask 5 and that of the phosphor stripes formed corresponding to the apertures is changed. Therefore, a landing error occurs in which the electron beams 10 transmitting through the apertures do not impinge on the proper phosphor stripes, resulting in degradation of color purity. Particularly, this doming is considerable at the initial operating state of the color picture tube. When an image of partial high brightness is formed, the doming partially occurs at the shadow mask 5 in the same manner as described above.

With respect to such a doming in the initial operating state of such a color picture tube, many suggestions have been made relating to the promotion of heat radiation from the central portion of a shadow mask or prevention of thermal conduction to the shadow mask. For example, in U.S. Pat. No. 2,826,538, it was proposed that a black layer formed of graphite be formed on a surface of a shadow mask so as to facilitate heat radiation of the shadow mask. In such a color picture tube, since this black layer serves as a good radiator, the temperature of the shadow mask is lowered. However, the black layer formed of graphite has the following drawbacks. Adhesion of the balck layer is degraded due to a heat cycle in the heat treatment during the manufacturing process of the color picture tube. When vibration acts on the color picture tube, a part of the black layer is separated, thereby causing microparticles to drop off. If these particles of the black layer become attached to the shadow mask, the apertures formed thereon are closed, resulting in degradation of the image quality on the phosphor screen. On the other hand, if the particles become attached to the electron gun, a spark between electrodes is induced, thereby degrading the quality of the color picture tube, and, in particular, causing degradation of the break-down voltage.

In U.S. Pat. No. 3,887,828 as a second example, a color picture tube was proposed. In this color picture tube, a porous layer of manganese dioxide is deposited at a side of an electron gun of a shadow mask, and an aluminum layer and a nickel oxide or nickel-iron layer are sequentially formed thereon by vacuum evaporation. In this case, since the thermal conduction coefficient of the porous layer is extremely small, heat caused by bombardment of an electron beam is not transmitted to the shadow mask, but is radiated in a direction away from the shadow mask. For this reason, the temperature increase of the shadow mask can be effectively controlled. However, in order to provide three layers on a surface of the shadow mask, considerable equipment and operation time are needed, resulting in poor mass-producibility.

SUMMARY OF THE INVENTION

It is an object of the present invention to provide a manufacturing method of a color picture tube in which a doming of the shadow mask in the initial operation state of a color picture tube is minimized, and degradation of color purity due to mis-registration of electron beams can be prevented, and which has good mass-producibility.

A manufacturing method of a color picture tube according to the present invention comprises the steps of:

forming a shadow mask having a main surface portion in which a plurality of apertures are formed;

coating at least one surface of said main surface portion of said shadow mask with ceramic material;

heat treating said shadow mask, thereby chemically bonding said ceramic material to said surface; and forming a phosphor screen, for emitting multi-color light by bombardment of the electron beams selectively transmitted through said apertures, on an inner surface of a panel using said shadow mask.

Any ceramic which has a lower thermal expansion coefficient than that of the metal of which the shadow mask is made can be used in the manufacturing method according to the present invention. Therefore when a ceramic material is chemically bonded to one surface of the shadow mask by heat treatment, a residual tensile stress remains in the shadow mask. Glass, preferably, lead borate glass, can be used as such a ceramic material.

A heat treatment process of a shadow mask according to the present invention must be performed before forming a phosphor screen. However, if performed before forming the phosphor screen, it can be performed before or after mounting the shadow mask on a panel as needed. When the heat treatment process is performed after mounting the shadow mask on the panel, a part of a ceramic material can be attached to the panel, and can be sintered. In order to prevent this, the ceramic material is heated prior to attaching it on the panel so as to preferably semi-melt it and to fix it onto the shadow mask.

A panel assembly formed of the panel and the shadow mask is generally subjected to a heat treatment (i.e., a so-called stabilization). This heat-treatment can be performed both for the panel assembly and for the shadow mask so as to form the ceramic layer. In this case, the number of manufacturing processes can be reduced and a short manufacturing time and low cost can be achieved, thereby allowing effective mass-production.

A ceramic layer can be formed on one or two surfaces of a main surface portion of the shadow mask. However, the ceramic layer is preferably formed at least at a side of an electron gun of the main surface portion on which the electron beams impinge, in order to reduce the temperature elevation of the shadow mask.

According to a method of the present invention, when the ceramic layer is formed by the heat treatment on a surface of a shadow mask, a residual tensile stress can occur in the shadow mask due to a difference between thermal expansion coefficients of the shadow mask and the ceramic material. For this reason, expansion of the sahdow mask can be suppressed even if the temperature elevates due to bombardment of electron beams onto the shadow mask during the operation of the color picture tube. As a result, a change in the relationship between the position of apertures of the shadow mask and phospor stripes can also be reduced.

As described above, according to the present invention, the doming of shadow mask can be effectively reduced and color purity degradation such as mis-registration and color irregularities can be prevented without the need for considerable manufacturing equipment and working time, thereby rendering it a valuable industrial process.

DETAILED DESCRIPTION OF THE PREFERRED EMBODIMENT

Figure 1:
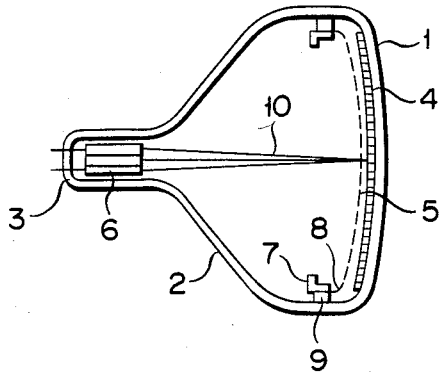
FIG. 1 is a sectional view showing a general arrangement of a shadow mask type color picture tube.

A manufacturing method of a color picture tube as an embodiment of the present invention will now be described with reference to the accompanying drawings. It should be noted that since the overall structure of the color picture tube is the same as that of the conventional one shown in FIG. 1, a detailed description thereof is omitted.

A photosensitizing solution containing alkali caseinate and ammonium dichromate was coated on two surfaces of a low carbon content steel plate having a thickness of 0.1 to 0.3 mm as a metal plate for manufacturing a shadow mask, and was dried, thereby forming resist films. Then, negative mask plates having a predetermined aperture pattern were brought to contact with this resist films, and were exposed to be developed, thereby forming resist patterns through which a portion of the steel plate for forming apertures therein was barred. An etching solution containing ferric chloride was sprayed on surfaces of the steel plate on which the resist patterns were formed so as to selectively etch the steel plate and to form apertures having a predetermined shape therein.

The steel plate having these apertures was cut into a predetermined shape so as to form a flat shadow mask consisting of a main portion having apertures and a peripheral portion having no apertures. Thereafter, the peripheral portion of the flat shadow mask was held by a blank holder and a die, and was formed into a predetermined curved surface using an upper punch and a lower knockout. Then, the peripheral portion was bent in the tube axis direction, thereby forming a skirt portion for supporting the curved main surface portion.

After above forming, the shadow mask is heated to 550° to 600° C. for 5 to 30 minutes in an atmosphere of, for example, a mixture of $N_2$ and CO or a mixture of steam and air, thereby forming a dark oxide layer on the surface of the shadow mask.

And then, the skirt portion of the shadow mask was fixed on a rigid mask frame having, for example, an L-shaped cross-section, thereby forming a mask assembly.

Next, ceramic material, for example, crystalline lead borate glass particles ("ASF-1307": Trade name; available from Asahi Glass Co., Ltd.) was coated on one surface of the curved surface portion of the shadow mask, for example, on a concaved surface at a side of an electron gun when the shadow mask was disposed adjacent to and opposing the phosphor screen. Coating of this crystalline lead borate glass particles was performed in the following manner. A suspension, slurry or paste in which lead borate glass particles having an average particle size of about 5 μm was dispersed in an alcohol solution of butyl acetate having nitrocellulose of several percent, e.g., 2%, was coated on the above-mentioned concaved surface to have a thickness of 20 to 30 μm. In this coating, blocking of the apertures must be prevented, and the layer must be controlled to have a predetermined thickness. In view of this, coating with a brush is undesirable. In a spraying method, the spraying time must be controlled with regard to the attachment efficiency of glass particles to the shadow mask. In an electrostatic coating method, the shadow mask is grounded as an anode, a negative high voltage (e.g., −90 K.V.) from a DC power source is applied to a spray apparatus, thereby forming an electrostatic field of a high voltage between the shadow mask and the spray apparatus. Lead borate glass particles sprayed from a supply tank through the spray apparatus are negatively charged in the electrostatic field and can be continuously attached to the shadow mask of an opposite polarity. In this case, since the particles can be coated on the shadow mask by an electric bonding force, a dispersion medium is unnecessary unlike the brushing and spraying methods. Therefore, the electrostatic coating method is preferred. A shielding plate can be used for a non-coating portion as needed. In locating glass particles by such an electrostatic coating method, since the attachment efficiency with which negatively charged glass particles are attached to the positively charged shadow mask is extremely high, material loss is very low and blocking of the apertures can be satisfactorily prevented. Also, when a constant electrostatic field is maintained, a glass layer having a highly uniform thickness can be obtained. Furthermore, since the glass particles are generally non-conductive, they can be easily charged and are preferably used in such an electrostatic coating method. The layer having these coated glass particles was dried, and thereafter heat-treated. In the heat treatment, the shadow mask assembly was passed through a heat treatment oven at a maximum temperature of 440° C. for 35 minutes. As a result, a crystallized lead borate glass material was chemically bonded to the electron gun side surface through the oxidized layer of the shadow mask 5.

The lead borate glass is vitrified within the Pb0 content range between 44 to 93% by weight. However, stability for crystallization can be obtained within the Pb0 content range between 70 to 85% by weight, thereby allowing mass-production. In order to crystallize the lead borate glass, an oven which can maintain a maximum temperature of 400° to 600° C. for 30 minutes or more is needed. Generally, a shadow mask assembly consisting of a shadow mask and a mask frame with a panel is stabilized at a temperature of 400° to 450° C. Therefore, if crystallization of the glass particles can be performed in this stabilization step, it is effective for mass-production. When the temperature of the stabilization does not coincide with the optimum temperature of the crystallization of the glass, ZnO or CuO may be added to the lead borate glass, thereby adjusting the optimum temperature for the crystallization of the glass. In this case, the glass can be crystallized at a low temperature without changing the thermal expansion coefficient of the glass.

When this shadow mask assembly is combined with the panel, a screen is formed on an inner surface of the panel. A diazo-based photoresist film was formed on the inner surface of the panel, and was exposed by using a high pressure mercury lamp through the apertures of the shadow mask. After developing the resist film, graphite was coated and dried thereon, and was then developed using a decomposer, thereby forming a light absorbing stripe at a predetermined position. A slurry containing an ADC - PVA system photoresist film in which phosphor particles, e.g., blue-emitting phospor particles were added was coated on the inner surface of the panel, and was exposed so as to form a blue-emitting phosphor stripe. Green- and red-emitting phosphor stripes were formed in the same manner as described above.

A panel assembly completed in the above-mentioned manner was coupled to a funnel by frit glass. After evacuation and the following predetermined process, a color picture tube was obtained.

It should be noted that it is undesirable to perform heat treatment for bonding of the glass layer to one surface of the shadow mask simultaneously with heat treatment for fusion-bonding the panel and the funnel after forming the screen. This is attributed to the following reason. When the glass is bonded to the metal, the relative distance between the screen and the shadow mask is slightly changed due to the residual stress in the shadow mask caused by the heating process, thereby, in some cases, causing a screen landing error of electron beams.

Figures 2A, 2B, 2C:
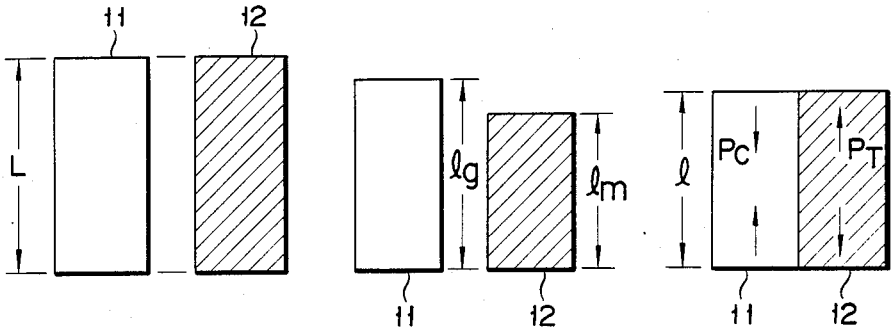
FIGS. 2A to 2C are views for explaining a bonding phenomenon between glass and metal.

As shown in FIG. 2A, when a metal 12 and a glass 11 are heated to a high temperature, e.g., 440° C. before bonding, the length L of both materials is the same. In this state, as shown in FIG. 2B, when both materials are cooled to a normal temperature without bonding, since a thermal expansion coefficient of the metal is selected to be slightly larger than that of the glass, the relationship between the both length becomes $lg > lm$. On the other hand, as shown in FIG. 2C, when the metal 12 and the glass 11 are bonded at a high temperature and are cooled to a normal temperature, the glass shrinks more under the influence of the metal. On the other hand, shrinkage of the metal is reduced due to bonding with the glass. Therefore, lengths at a normal temperature of these materials after bonding satisfy $lg > l > lm$. As a result, a compression stress Pc remains in the glass, and a tensile stress $P_T$ remains in the metal as residual stresses. Generally, when a metal is bonded to glass, it is necessary that undesirable stress must not act on the glass. In the glass, the compression strength thereof is about ten times the tensile strength thereof. Therefore, since preferably only a small compression force acts on the glass after bonding, the thermal expansion coefficient of the metal is preferably larger than that of the glass. A shadow mask 5 consisting of a cold rolled steel plate generally has a thermal expansion coefficient of $1.2 \times 10^{-5}$/°C. The crystallized lead borate glass having a PbO content of 70 to 85% has a thermal expansion coefficient of 0.7 to $1.2 \times 10^{-5}$/°C., and can be satisfactorily used for bonding to the shadow mask of cold rolled steel plate. The shadow mask is subjected to the above-mentioned residual stresses in the crystallization process after coating the glass particles on the shadow mask, thereby causing slight deformation. For this reason, in some cases, relative positions of the apertures are slightly changed. However, since the phosphor stripes constituting the screen are formed in correspondence with the positions of the apertures, changes in the relationship between the positions of the apertures and the phosphor stripes due to the residual stresses in the following steps cannot occur if the screen is formed after the heat treatment for crystallization. Therefore, the above-mentioned processes for forming the glass layer on the shadow mask must be completed before forming the screen.

When the color picture tube having the structure as described above is operated, the temperature of the shadow mask is increased by the heat generated in the crystalline lead borate glass on which the electron beams bombard. However, since the residual tensile stress acts on the shadow mask, thermal expansion of the shadow mask in the initial state can be considerably suppressed.

Figure 3:
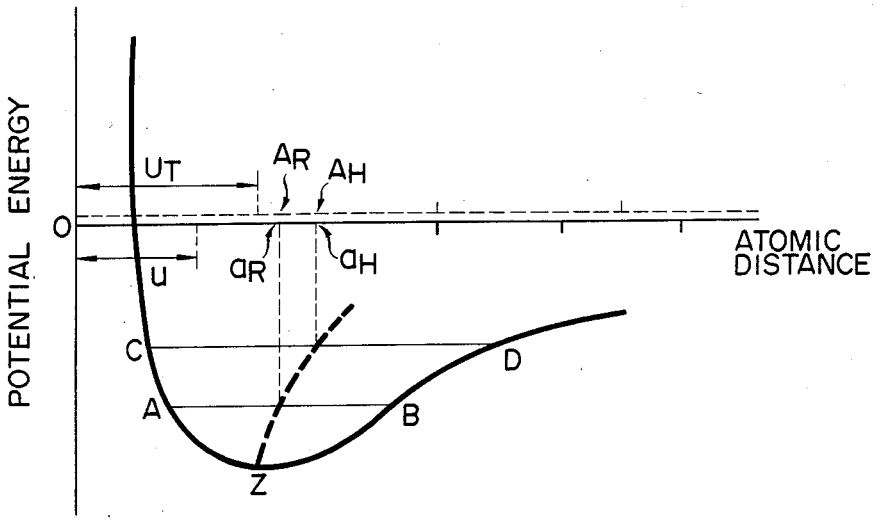
FIG. 3 is a graph for explaining a thermal expansion phenomenon of a solid material.

This mechanism will be described with reference to FIG. 3. FIG. 3 is a graph showing a potential energy exist between atoms (ordinate) as a function of a distance between atoms of material (abscissa). Since vibrations of atoms at a given temperature are not harmonic, a potential energy curve becomes asymmetrical with a potential energy point Z at absolute zero. Therefore, in FIG. 3, an average distance between atoms which respectively vibrate between positions corresponding to A and B at a normal temperature is given as $a_R$. Energy is increased in accordance with an increase in temperature, and if atoms vibrate at positions corresponding to C and D, an average distance between atoms becomes $a_H$ to asymmetry of the potential energy curve. Therefore, atoms are displaced from their equilibrium positions in accordance with an increase in amplitude of vibration. An average displacement $\Delta l = a_H - a_R$ of atoms in a solid body is known to be the cause for thermal expansion.

There will now be discussed thermal expansion of the shadow mask in the case where, as in the present invention, a residual tensile stress remains in the shadow mask by forming the crystalline glass layer on one surface of the shadow mask. In this case, the distance between atoms which constitute the shadow mask is extended by the residual tensile stress. If this is expressed using FIG. 3, the ordinate, i.e., an amount of potential energy is constant, and the abscissa, i.e., a unit length of a distance between atoms, is extended from u to $u_T$ (new abscissa is shown by a dotted line). Therefore, thermal expansion of $a_H - a_R = \Delta l$ conventionally occurs by an increase in temperature of the shadow mask due to bombardment of electron beams (abscissa is shown by a solid line). However, in the shadow mask according to the present invention, since residual stres exists, thermal expansion of only $A_H - A_R = \Delta l_T$ occurs. As described above, since a unit length u of the abscissa shown by the solid line is smaller than a unit length $u_T$ of the abscissa shown by the dotted line, the relationship between a conventional thermal expansion amount $\Delta l$ and a thermal expansion amount $\Delta l_T$ according to the present invention becomes $\Delta l_T = (u/u_T) \times \Delta l$. Therefore, as is apparent from the above description, the thermal expansion amount $\Delta l_T$ of the shadow mask according to the present invention is smaller than that of the conventional one.

Furthermore, when the crystalline lead borate glass layer is formed at the side of the electron gun of the shadow mask as in this embodiment, since the thermal conductivity of the crystalline lead borate glass is extremely small, the amount of heat, which is generated by bombardment of electron beams on the surface of the crystalline lead borate glass and is radiated before it is transmitted to the shadow mask is increased in comparison to the conventional shadow mask, resulting in satisfactory control of temperature increase of the shadow mask.

An application in which the present invention is applied to a 21-inch color picture tube will now be described. A suspension containing lead borate glass particles ("ASF-1307"; available from Asahi Glass Co., Ltd.) having a thermal expansion coefficient of about $1.0 \times 10^{-5}$/°C. near the softening point was coated on a major surface on the electron gun side of the shadow mask, which was formed of cold rolled steel plate of a thickness of 0.22 mm in the above-mentioned manner. Thereafter, the resultant structure was heat treated so as to vitrify the glass, thereby obtaining a crystalline glass layer having a thickness of about 25 μm. The adopted shadow mask has a radius of curvature in a horizontal direction of about 1,000 mm, a horizontal pitch of phosphor stripes of about 260 μm, and a light-absorbing area of about 120 μm between respective phosphor stripes.

Such a color picture tube was operated at an anode voltage of 25 kV and an anode average current of 1,500 μA. The maximum displacement along a horizontal direction of the electron beams after five minutes from the start of the operation was checked. A measuring point is a portion spaced about 140 mm apart from an image center along a horizontal direction at which the doming easily occurs. In this color picture tube, electron beams land on one phosphor stripe and two neighbouring light-absorbing stripes (negative landing). Luminance is decreased by a constant displacement even if the landing point is not moved to the next phosphor stripe. Particularly, with reference to the green phosphor which considerably affects luminance, the landing tolerance of the electron beam of the electron gun is about 75 μm. In this color picture tube, the miss-landing amount of the electron beam was about 85 μm when the present invention was not adopted, and that of the electron beam according to the present invention was about 66 μm. Then, it was confirmed that the electron beam of the present invention was sufficiently within the allowed tolerance. In other words, thermal expansion in accordnace with the increase in the residual tensile stress of the shadow mask by the crystalline glass layer, and an increase in temperature in accordance with the decrease in the thermal conductivity by the crystalline glass layer are effectively controlled.

When the chrystallization of the glass is performed in the stabilization step, the shadow mask assembly, one surface of which is coated with a dispersion or suspension containing the lead borate glass particles, is provided in the panel 1. In this case, the coated material may drip and may be attached to an inner surface of the panel 1, and in the following stabilization step, it may be sintered. This can be prevented in the following manner. After the dispersion or suspension containing the lead borate glass particles is coated on one surface at the electron gun side of the shadow mask 5 and before the shadow mask 5 is mounted in the panel 1, the coating layer is heat treated so as to semi-melt the glass and to fix it to the shadow mask 5. Thereafter, the shadow mask assembly is mounted in the panel 1 and is subjected to the heat treatment in the stabilization step.

One condition for effectively bonding the metal to the glass in that the metal is chemically intimate with the glass, that is, the glass has the good wettability of a metal.

In the present invention, when the lead borate glass is bonded to one surface of the shadow mask 5, this condition is satisfied by increasing the temperature of the glass to its softening temperature. For this reason, in the heating process of the shadow mask assembly, when a furnace is used, the equipment and time for increasing temperature are considerable, thus preventing mass-production. The present inventors paid attention to the fact that the shadow mask 5 had good conductivity. Then, the shadow mask 5 was disposed in a coil and a high frequency current was made to flow in the coil so as to generate an eddy current in the shadow mask 5 by electromagentic induction. The present inventors confirmed that the shadow mask 5 could be heated at high temperatures in an extremely short time by the eddy current. For example, a dispersion containing about 75% by weight of PbO and about 9% by weight of $B_2O_3$ was coated on a surface at the electron gun side of the main surface portion of the shadow mask 5 formed of cold rolled steel with a thickness of 0.22 mm. Then, the shadow mask 5 was disposed in a coil connected to a high frequency source of a transformer output of about 15 KVA and a frequency of about 400 KHz, and then was subjected to the heat treatment. The temperature of the shadow mask 5 reached the softening temperature of 400° C. of the lead borate glass within five seconds, and after five minutes, the lead borate glass was semi-melted and was fixed to the shadow mask 5. Since this glass layer was fixed to the shadow mask 5 by a chemical bond, the bonding strength was considerably improved in comparison to conventional bonding using a binder. In addition, the glass was not easily disconnected from the shadow mask in the following steps.

What is claimed is:

1. A manufacturing method of a color picture tube having a shadow mask with a ceramic coating, comprising the steps of:

forming a shadow mask having a main surface portion in which a plurality of apertures are formed;

coating at least one surface of said main surface portion of said shadow mask with ceramic material having thermal expansion coefficient smaller than that of said shadow mask; said at least one surface being on the electron gun side of said shadow mask;

heat treating said shadow mask, thereby chemically bonding said ceramic material to said surface; and thereafter forming a phosphor screen, for emitting multi-color light by bombardment of the electron beams selectively transmitted through said apertures, on an inner surface of a panel using said shadow mask and subsequently sealing said picture tube with said mask and coating incorporated therein.

2. A method according to claim 1, wherein one of ceramic materials, a suspension, slurry and paste which respectively contain ceramic particles is coated on said surface.

3. A method according to claim 2, wherein said coating is performed by an electrostatic coating method.

4. A method according to claim 1, wherein said heat-treating step comprises a first heat-treating step in which said coated ceramic layer is heated to be at least semi-melted, and a second heat-treating step in which said semi-melted ceramic layer is chemically bonded to said surface.

5. A method according to claim 4, wherein said first heat-treating step is performed before said shadow mask is disposed in said panel, and said second heat-treating step is performed after mounting said shadow mask.

6. A method according to claim 4, wherein said first heat-treating step comprises heating at a substantially softening temperature of said ceramic material for more than five minutes.

7. A method according to claim 4, wherein said first heat-treating step is performed by high frequency heating using a high frequency coil.

8. A method according to claim 1, wherein said heat-treating step of said shadow mask is performed in a stabilization step after mounting said shadow mask in said panel and before forming said screen.

9. A method according to claim 1, wherein said ceramic layer is formed of glass.

10. A method according to claim 9, wherein said glass is lead borate glass.

11. A method according to claim 9, wherein said chemically bonded ceramic material is a crystalline glass.

* * * * *